US006595199B1

(12) United States Patent
Andersen et al.

(10) Patent No.: US 6,595,199 B1
(45) Date of Patent: Jul. 22, 2003

(54) STOVE FOR SOLID FUEL

(75) Inventors: Viggo Søren Andersen, Randers (DK); Peter Pors Jessen Hansen, Nykøbing Mors (DK)

(73) Assignee: Morsø Jernstøberi A/S, Nykøbing Mors (DK)

( * ) Notice: Subject to any disclaimer, the term of this patent is extended or adjusted under 35 U.S.C. 154(b) by 0 days.

(21) Appl. No.: 09/701,373

(22) PCT Filed: May 28, 1999

(86) PCT No.: PCT/DK99/00287

§ 371 (c)(1),
(2), (4) Date: Nov. 29, 2000

(87) PCT Pub. No.: WO99/64789

PCT Pub. Date: Dec. 16, 1999

(30) Foreign Application Priority Data

May 29, 1998 (DK) ..... 1998 00710

(51) Int. Cl.[7] ..... F24C 1/14

(52) U.S. Cl. ..... 126/77; 126/290; 431/62; 110/190

(58) Field of Search ..... 126/77, 146, 290, 126/285 R, 500, 502, 289; 431/12, 18, 6, 62, 76, 75, 74, 67; 110/185, 190

(56) References Cited

U.S. PATENT DOCUMENTS 2,345,519 A * 3/1944 Wingert ..... 126/77
4,449,918 A * 5/1984 Spahr ..... 431/76
4,556,044 A 12/1985 Barsness et al. ..... 126/77
4,576,570 A * 3/1986 Adams et al. ..... 431/76
4,643,165 A * 2/1987 Chamberlain ..... 126/77
4,832,000 A * 5/1989 Lamppa et al. ..... 126/77
5,341,794 A * 8/1994 Henry et al. ..... 126/77
5,666,889 A 9/1997 Evens et al. ..... 110/190

FOREIGN PATENT DOCUMENTS

DE 29 09 539 9/1979
DE 0147477 A * 4/1981 ..... 126/77
EP 0250238 A * 12/1987 ..... 126/77
EP 0 604 388 6/1994
SE 80066137 9/1980

* cited by examiner

*Primary Examiner*—Henry Bennett
*Assistant Examiner*—Josiah Cocks
(74) *Attorney, Agent, or Firm*—Nixon Peabody LLP; David S. Safran

(57) ABSTRACT

A stove for solid fuel, with sensor controlled, motor driven adjustment means for respective different types of intake air and with a control unit which is programmable for selective control of the adjustment means in order to optimise the combustion under various operational conditions, in particular during a lighting up phase, an operative phase of high or low effect, a refiring phase, and a burn-out phase.

10 Claims, 2 Drawing Sheets

STOVE FOR SOLID FUEL

Figure 1:
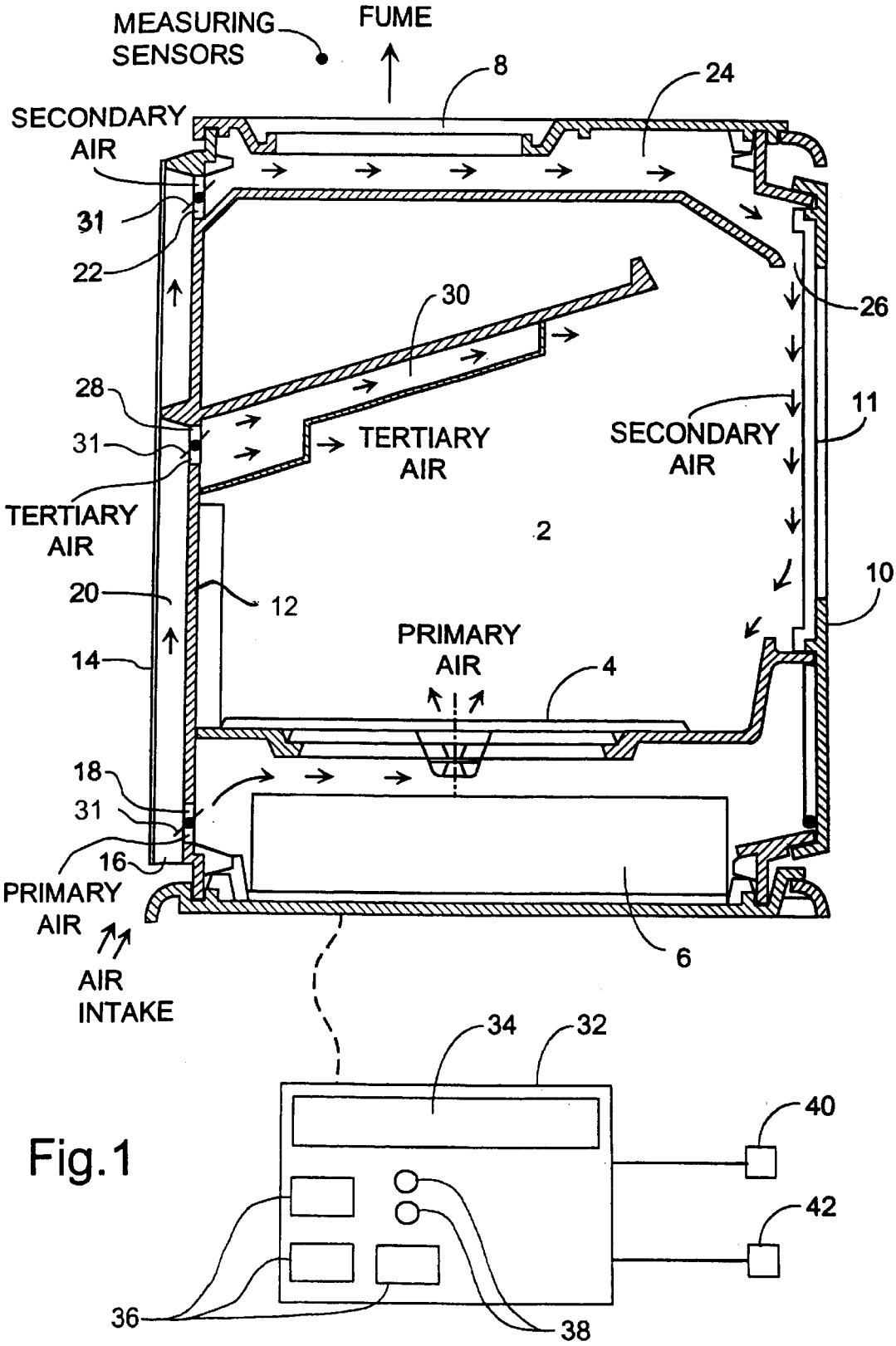

The present invention concerns a stove for solid fuel, typically for the heating of one or more living rooms and using wood and/or briquettes as fuel. Such stoves can be configured with different shapes for more or less regulation of the air supply, whereby distinction is made between the following kinds:

A: Primary air: Air which from a lower intake opening is fed to the area down under the stove's fire grating which supports the fuel over an underlying ash drawer, said air thus being drawn up directly through the fuel pile upon the effect of an arising or commenced combustion and related heat development in the fuel, respectively by a chimney draft established hereby with the view to strong feeding of the fire.

B: Secondary air: Air which is supplied to the pile of fuel over the fire grating, preferably after passage of a channel system in the stove for the pre-heating of this air, with the view to moderate feeding of the fire, and C: Tertiary air: Air which is supplied to the uppermost of the combustion chamber, with the view to supplying oxygen for ensuring that remaining combustible gases are burned off, partly for maximum utilisation of the fuel by clean combustion and partly to preclude danger of explosion.

The respective air intake openings are normally provided with dampers which can be regulated manually, and which following instructions the user can operate in an appropriate manner in various operational phases of the stove, but it is also known, however, to let one or more of these dampers be controlled automatically, based on a bimetallic sensing of the combustion temperature, i.e. with the view to achieving an even combustion with the desired intensity.

However, it is also known to use an electrical servo-control of the regulation dampers for intake air, cf. EP-A-0 604 388, depending on a sensing of the temperature of the flue gas, and also depending on a measurement by means of a lambda sensor of the CO contents of the gas. No distinction is made here between different air supplies or different operational situations. When or after a stove burns out, a total closing of the regulation damper for intake air is effected, among other things to prevent flue gas explosion, and thereafter the damper is opened depending on a sensed opening of the stove door for renewed starting of the stove.

U.S. Pat. No. 4,556,044 discloses a stove with inlets for both primary and secondary air, and with a damper which can be switched over between expedient air distributions with respectively "high fire", "normal combustion" and "low combustion". Use is made of a damper which by being switched over serves the two air intakes simultaneously.

However, it is hereby characteristic that the relevant automatic control refers precisely to the operative normal combustion in the stove, and not at all to the conditions which arise in respectively a lighting-up, a re-firing and a burning-out sequence, where the ideal air controls are quite different from the conditions during the normal combustion. It is precisely for this reason that the user should be informed how the dampers should stand during these special phases, but even with this knowledge it will be almost impossible for the user to operate the dampers in an optimum manner, when the control parameters comprise limit values for the combustion temperature and for the content of oxygen in the flue gas.

In the light of the above, with the invention there has been taken the special step of introducing an overriding, electronic and individually-directed control of the damper positions by a programmed control unit with keying-in function, which makes it possible for the user to inform the control unit that there has now been initiated a lighting-up or a re-firing phase, after which by means of sensors connected for the temperature of and possibly the oxygen content of the flue gas, the control unit will be able to control the air supplies in an optimum manner, also during the lighting-up, the re-firing and burning-out phases.

In practice, this will manifest itself by use being made of regulation dampers which in a mutually independent manner are driven by controllable step-motors, and that in connection with the stove installation there is provided an operation box which, e.g. has keying-in means in the form of pushbuttons, enables the user to key-in the time for or the event of an actual lighting-up of the oven. The same operation box can have keys for entering a desired working temperature of the stove, preferably merely for either "high" or "low effect", and possibly have a display which confirms to the user that the oven is now operating under "lighting-up"conditions or normal operation, or possibly in the burning-out condition, the latter as a signal to the user that the stove must be fed with new fuel if it is desirable to maintain the burning function. This information can possibly be supported by the emission of an acoustic alarm signal which, however, the user ought to be able to deactivate, e.g. if the oven with adjusted related air control is desired to burn out after bedtime. On the other hand, if the user chooses to add new fuel, the control unit can be fed with this information by a simple entry via the keypad, after which the air control undergoes a radical change for a favourable ignition of the new fuel.

The overriding control parameter will naturally be the temperature, which is best measured with a sensor placed in the flue gas discharge pipe, preferably 15–20 cm up in the flue gas discharge pipe. The user can key-in a desired combustion temperature, e.g. of 300° or 400°, corresponding respectively to said "low" and "high" effect, and if or when it is ascertained via the sensor that the temperature is lower than the desired value, the control must then be directed in very different ways, depending on whether this is the result of a lighting-up phase or a random reduction in connection with an already-established combustion sequence. When lighting-up, there should thus be established a full air supply, while with an operative temperature reduction there should only be carried out a graduated or selective alteration of perhaps only one of the air intakes. In its way, it will be relatively easy to programme the control unit in such a manner that it can automatically detect whether the one or the other situation arises, since via the sensor it will, of course, be able to be registered whether there has previously arisen a more or less high operating temperature or whether there occurs an increase in a very low ignition temperature, and on this basis the lighting-up can possibly be registered in a fully automatic manner. However, it will give an even more sure control signal if the user indicates a lighting-up by a keying-in signal.

When lighting-up and with normal working operation, it is the said primary and secondary air supplies which are in focus, controlled only by the flue gas temperature. During the lighting-up phase, the primary air damper should be held completely open for approx. 10 minutes, also after the temperature of the flue gas has reached up to its set value of e.g. 300 or 400°, in that this damper, however, can then be controlled for a limited opening of e.g. 10–20% with the object of establishing a warming-through of the stove. After these approx. ten minutes, and after the desired operating temperature has been reached, the control unit can bring about a total closing for the flow of primary air. This applies also to operative conditions as well as with burning out.

The damper for the said secondary air must be controlled in such a way that it can not be totally closed so long as a combustion can at all take place in the stove, in that the secondary air will be responsible for the maintaining of a minimal combustion, also during a burning-out phase when the primary air is shut off, and a small intake of air will preclude the risk of explosion. During the lighting-up phase, the supply of secondary air must be fully open, while after a warming-through has been achieved, e.g. after the said 10 minutes, a change is made to actual regulation operation precisely with the help of the secondary air. If, during operation, a change is made from "high effect" (400°) to "low effect" (300°), a down-regulation is effected, preferably so that the stove is controlled down in steps of e.g. 10° per minute, which will provide a more or less even fall in the temperature.

In the event of "fuel needed" or during the start of a burning-out phase, e.g. defined by a temperature interval between 300° and 230°, the secondary air should be fully opened for optimum utilisation of the fuel, so that this air can have as good an ignition effect as possible on the newly added fuel, while with a definite burning-out, e.g. defined by the temperature range between 230° and 50°, there can be throttled down to an only slightly open supply of secondary air. When the stove has gone out (T<50°), the damper should be closed completely.

The object of the tertiary air is to ensure a clean combustion, i.e. with low emission of carbon monoxide and other combustible gases. In an indirect, but reasonably reliable and inexpensive manner, this can be monitored by using an oxygen flow-meter of the lambda probe type, in that for example it has been found that combustion is clean when, at a flue gas temperature of 400°, there appears an oxygen content in the flue gas of more than 9%, while the corresponding value at 300° is 12%. If the oxygen content is greater or smaller, a regulation of the tertiary air must be made respectively up or down. During the lighting-up, the air supply must be at maximum, while at "fuel needed" or the start of a burning-out (230°<T<300°), operation can take place with a requirement control based on the information from the lambda probe. When the stove has gone out completely and with a cold stove, the supply should be closed.

Figure 2:
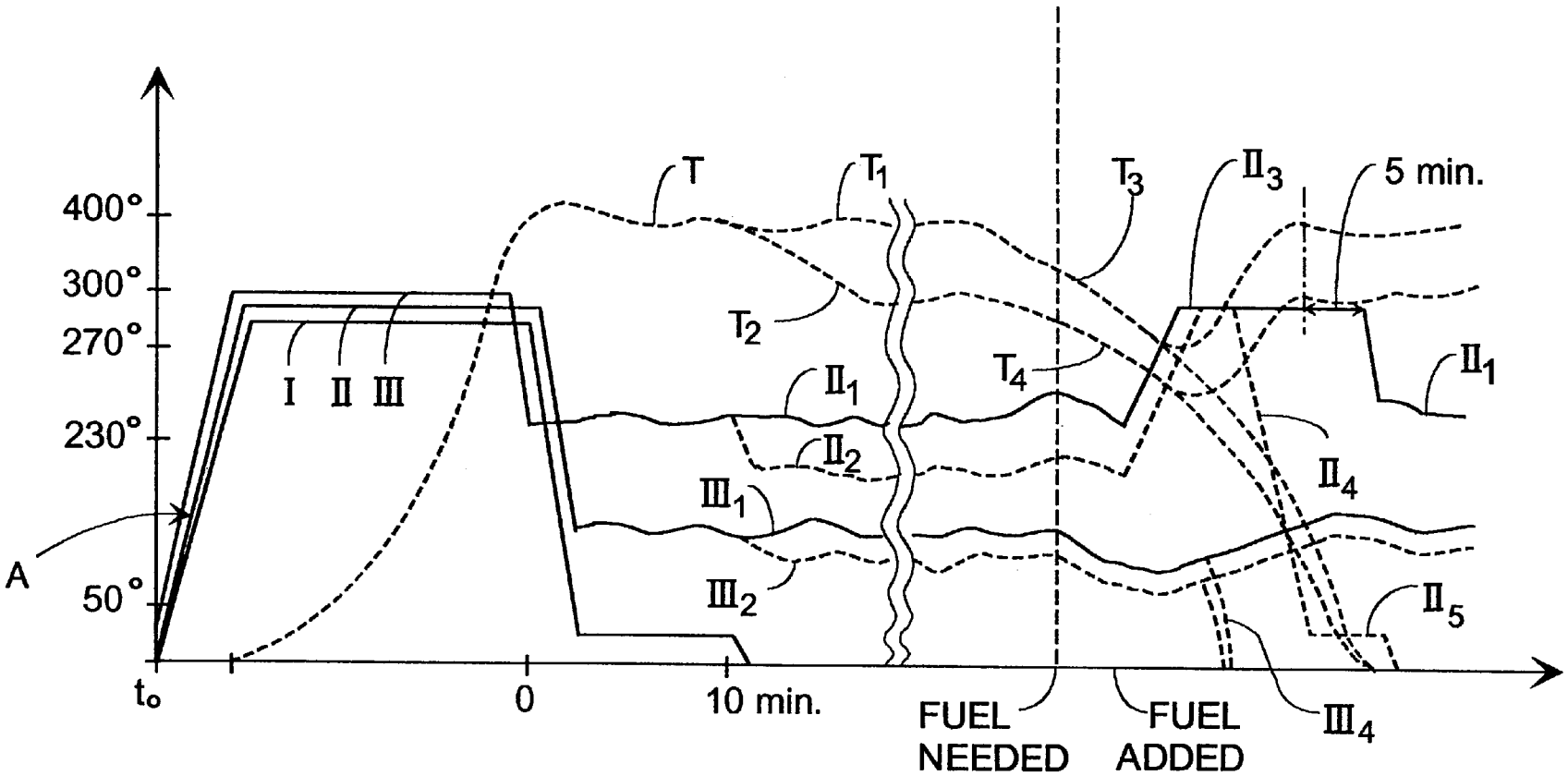

In the following, the invention is explained in more detail with reference to the drawing, in which FIG. 1 shows a schematic cross-section of a stove with associated control equipment according to the invention, and FIG. 2 is a control diagram which shows the sequence of damper positions in relation to the stove temperature.

The shown stove has a combustion chamber 2 with a fuel grating 4 and an underlying ash drawer 6, an overlying flue gas discharge 8 and an access door 10. At the rear wall 12, opposite which there is a shield plate 14, there is an air intake 16, in that in the rear wall 12 immediately above the air intake 16 there is an inlet opening 18 for primary air for the area down under the fire grating 4.

Uppermost in the air channel 20, which is formed between the rear wall 12 and the shield plate 14, there are configured one or more inlet openings 22 for secondary air, which via an upper channel 24 is fed to an opening 26 for the introduction of secondary air into the space above the grating 4, such as shown by a series of arrows. During normal operation, the secondary air is supplied in strongly heated state and at a good speed, so that it can flush down along a glass window 11 provided in the door 10 and hereby keep this free of soot.

Midway up in the channel space 20 there is an inlet opening 28 in the rear wall 12 for tertiary air, which via a channel system 30 extending into the combustion chamber can be supplied to a centre area of this chamber to ensure the burning-off of remaining combustible gas.

In each of the air inlet openings 18, 22 and 28, there is a damper plate 31 which can be regulated, and which is connected to a not-shown actuator such as a step-motor for controllable opening/closing of the respective damper plates 31.These are shown as pivotal plates, but in practice it is preferred to work with displaceable plates which can be displaced for greater or smaller covering of the triangular damper openings 18,22 and 28.

The damper 22,30 for the secondary air is arranged in such a manner that it is blocked purely mechanically against being able to be totally closed, in that to preclude any risk of explosion in a closed-down stove, the stove should be provided with a very weak flow of air under all circumstances, i.e. also upon failure of the power supply for the actuators which drive the damper plates 31.

The control box 32 shown in the drawing belongs with the stove, in that e.g. it can be mounted on a wall over or at the side of the stove. This box has a display 34 which can show various operational conditions such as "stove gone out", "stove lighting-up", "high effect", "½ effect", "low effect", "stove burning out" or "fuel needed". The control box also has pushbuttons 36 for entering commands in connection with the user's selection of "lighting-up" and selection of high and low effect respectively, for example given by the said flue gas temperatures of respectively 300 and 400°. Moreover, the control box can have signal lamps 38 for the indication of special operating conditions such as "fuel needed" or "stove gone out", regardless of whether the same message is possibly also shown in the display 34. However, the display can possibly be dispensed with.

The control box can also comprise or be connected to a clock 40 and a room thermostat 42.

The regulating sequence already described is illustrated in FIG. 2, where I, II and III represent the damper openings for primary, secondary and tertiary air respectively, while T indicates the flue gas temperature. When the control unit is coupled electrically with a cold stove, the regulating dampers for all three types of supply air will be immediately fully opened, cf. the rising curves A. The curve system is shown on a time axis t, where $t_o$ represents a point in time, where the user connects current to the control system in connection with the stove being taken in use. All three regulation dampers are hereby controlled for full opening as shown at A. At $t_i$, an ignition is effected, and in that connection the user presses a button for the selection of either "high" or "low" effect, partly to mark this selection and partly to mark the time of ignition.

Regardless of the selection made, in the ignition phase the dampers will remain fully open, and the temperature of the flue gas will rise to around 400°. When this-is registered by the temperature sensor, at the time "0" there will occur a down-regulation of the air intakes, so that the secondary air and tertiary air supplies are switched over to "operative conditions" for maintaining the said high level of the flue gas temperature. On the other hand, the damper for the primary air will be displaced to a position in which it is only slightly open, which is maintained throughout the following approx. 10 minutes, which represent a "warming-through phase" for the stove.

After these approx. 10 minutes, marked by "10" on the time axis, the primary air damper is fully closed, and the control unit now recalls whether the high or the low effect has been selected. With high effect, the operative regulation of secondary and primary air is continued along respective curves $T_1$, $II_1$, and $III_1$, while at low effect a change occurs to control via respective curves $I_2$, $II_2$ and $III_2$ for maintaining the flue gas temperature at approx. 300°.

During operation, the user can add new fuel in accordance with an expected requirement, without this having any influence on the control, but if the temperature falls to e.g. 270° at "high effect" ($T_3$) or 240° at "low effect" ($T_4$), the control unit will then, e.g. via a lamp, indicate "fuel needed".

This is a critical point, in that the control hereafter will switch to a special "burn-out" control if a refiring is not effected more or less quickly. If a re-firing is effected, the user must therefore inform the control unit via the keys that new fuel has now been added, as is marked on the time axis. There is hereby selected a "re-ignition"function, by which the control unit effects full opening for the secondary air, $II_3$, until the working temperature has been re-established. This full opening is preferably maintained for approx. 5 minutes in order to ensure renewed warming-through, after which there is a change to "working operation"again. There can possibly be arranged an automatic registration of the re-firing, e.g. by the sensing of movement in the fire chamber. During the re-firing phase, the lambda probe continues its normal regulation of the tertiary air.

On the other hand, if "fuel added" is not marked, or if such an addition is made so late that an effective re-kindling of the fire cannot be counted on, e.g. at a fall in temperature to below 270°, the control will then set itself for "burn-out", whereby the secondary air is fully opened for good utilisation of the last fuel, though only until it is ascertained that the temperature falls further to e.g. 230° as a sign of continued burn-out. Hereafter, the control effects a closing-down of both the secondary and the tertiary air ($II_4$ and $III_4$) but, however, while maintaining a weak supply of secondary air $II_5$ until the stove has completely burnt out ($T<50°$).

The control can also be regulated up and down by signals from the clock 40 or from the thermostat 42.

It should be mentioned that from controlled experiments with stoves of different types, it has been found possible to simplify the control of the tertiary air, in that the oxygen or the CO meter can be dispensed with, and instead work with permanent settings under various operating conditions. For example, in connection with a given type of stove it can be found that at "low" secondary air (e.g. at a damper setting of 0–2 on a step scale of up to 10), the damper for the tertiary air can be set at step 7 at a flue gas temperature of 300° or at step 3 at 400°, while the corresponding steps should be 1 and 0 respectively at "high" secondary air (step 5–10). The lambda probe can hereby be dispensed with and the control as a whole is simplified.

What is claimed is:

1. Stove of the kind which is provided with sensor-controlled means of regulation for the intake of combustion air with the object of maintaining a desired temperature level, wherein a control equipment for the stove is arranged to work in accordance with different, selected control algorithms under various operational conditions, characterized in that, particularly during a lighting-up phase, an operative phase at high or low effect, a re-firing phase and a burn-out phase, separate air intakes are provided for primary and secondary air and also for tertiary air, and that, in these intakes, there are provided dampers which can be regulated individually, which enables a selective and graduated throttling of each of the air intakes according to various operational conditions; and is further provided with a combustion chamber bounded on one side by a vertical wall, an air channel formed between said vertical wall and a vertical outer shield wall, said air channel having a main air intake opening at a bottom part thereof for drawing outside air into the air channel, wherein the air intake for primary air is located to deliver air from said air channel through a lower area of said vertical wall into a lower part of said combustion chamber, the air intake for tertiary air is located to deliver air from said air channel through an intermediate area of said vertical wall into said combustion chamber and said air intake for secondary air is located to deliver air from said air channel through an upper area of said vertical wall for delivery to said combustion chamber.

2. Stove according to claim 1, where, in a sensed or start-marked lighting-up phase, the air intakes are fully opened until a pre-set temperature is detected, after which the dampers are throttled down for air intake over a predetermined period of time, after which the air intake is further reduced for changeover to operative conditions.

3. Stove according to claim 1, whereby means are provided for the detection or keying-in of the "re-firing" phase, and in that this results in an increase in the supply of intake air over a predetermined period of time, or until it is registered that the desired effect has been achieved, depending on a prior registration by the sensor-controlled means of regulation of falling flue gas temperature.

4. Stove according to claim 1, whereby, in said burn-out phase, the sensor-controlled means of regulation brings about a strong throttling down of the intake air, depending on a registration of a fall in temperature to a predetermined level.

5. Stove according to claim 1, whereby maximum down-throttling of the air is effected depending on a detected burning-out of the stove.

6. Stove according to claim 1, whereby, after the lighting-up phase, the secondary air is throttled down and also the tertiary air for changeover to operative control, while the supply of primary air is throttled down to a low value during said warming-through phase, after which this supply is closed.

7. Stove according to claim 1, whereby only the supply of secondary air is increased during the re-firing phase.

8. Stove according to claim 4, wherein the supply of tertiary air is throttled down completely, while a slight intake of secondary air is maintained until bum-out is detected.

9. Stove according to claim 1, whereby, during an operative phase, the tertiary air is controlled either on the basis of a measurement of the oxygen in the discharge gas, or by predetermined damper positions during operation of the stove at respective different effect levels.

10. Stove according to claim 1, wherein a door with a glass window is located on an opposite side of said combustion chamber from said vertical wall, and wherein said air intake for secondary air communicates with an upper channel extending across an upper end of the combustion chamber, said upper channel having an outlet arrange to cause the secondary air to flush an inner surface of said glass window.

* * * * *